US009831539B2

(12) United States Patent
Shiroyama et al.

(10) Patent No.: US 9,831,539 B2
(45) Date of Patent: Nov. 28, 2017

(54) WAVEGUIDE COAXIAL CONVERSION DEVICE AND TRANSMISSION/RECEPTION INTEGRATED SPLITTER

(71) Applicant: NEC Corporation, Tokyo (JP)

(72) Inventors: Norihisa Shiroyama, Tokyo (JP); Kiyotake Sasaki, Tokyo (JP); Sumio Ueda, Tokyo (JP); Takahiro Miyamoto, Tokyo (JP)

(73) Assignee: NEC Corporation, Tokyo (JP)

( * ) Notice: Subject to any disclaimer, the term of this patent is extended or adjusted under 35 U.S.C. 154(b) by 50 days.

(21) Appl. No.: 15/027,498

(22) PCT Filed: Oct. 3, 2014

(86) PCT No.: PCT/JP2014/005064
§ 371 (c)(1),
(2) Date: Apr. 6, 2016

(87) PCT Pub. No.: WO2015/052904
PCT Pub. Date: Apr. 16, 2015

(65) Prior Publication Data

US 2016/0248138 A1 Aug. 25, 2016

(30) Foreign Application Priority Data

Oct. 7, 2013 (JP) ..... 2013-210072

(51) Int. Cl.
*H01P 5/103* (2006.01)
*H01P 1/383* (2006.01)
(Continued)

(52) U.S. Cl.
CPC ..... *H01P 1/383* (2013.01); *H01P 1/20* (2013.01); *H01P 5/08* (2013.01); *H01P 5/103* (2013.01); *H01P 5/107* (2013.01)

(58) Field of Classification Search
CPC ..... H01P 5/08; H01P 5/103; H01P 5/085
(Continued)

(56) References Cited

U.S. PATENT DOCUMENTS 2,513,761 A 7/1950 Tyson
4,409,566 A 10/1983 Patton et al.
(Continued)

FOREIGN PATENT DOCUMENTS

JP 5-75201 10/1993
JP 2001-102856 4/2001
(Continued)

OTHER PUBLICATIONS

Extended European Search Report issued by the European Patent Office in counterpart European Patent Application No. 14852270.9-1927, dated Apr. 18, 2017.
(Continued)

*Primary Examiner* — Stephen E Jones
(74) *Attorney, Agent, or Firm* — Finnegan, Henderson, Farabow, Garrett & Dunner, L.L.P.

(57) ABSTRACT

A coaxial waveguide conversion device according to the present invention includes a first member; a second member provided so as to be opposed to the first member; and a conductor plate provided so as to be sandwiched between the first member and the second member. A waveguide is formed in the first member and the second member to a depth that penetrates the first member and does not penetrate the second member. The conductor plate includes an opening having a shape corresponding to a shape of an aperture plane of the waveguide; a conductor surface portion provided around the opening; an antenna portion; a waveguide short-circuit portion connecting the antenna portion with the conductor surface portion; a coaxial wiring portion provided at one end of the antenna portion; and a coaxial line
(Continued)

short-circuit portion connecting another end of the antenna portion with the conductor surface portion.

7 Claims, 6 Drawing Sheets

(51) Int. Cl.
*H01P 5/107* (2006.01)
*H01P 1/20* (2006.01)
*H01P 5/08* (2006.01)

(58) Field of Classification Search
USPC ..... 333/26, 25, 33, 21 R, 254, 260
See application file for complete search history.

(56) References Cited

U.S. PATENT DOCUMENTS 4,550,296 A 10/1985 Ehrlinger et al.
6,486,748 B1 11/2002 Stones et al.
2001/0033205 A1 10/2001 Ikeda
2004/0041651 A1* 3/2004 Shono ..... H01P 5/107 333/26
2010/0117757 A1 5/2010 Yano
2015/0054593 A1* 2/2015 Wang ..... H01P 5/107 333/26

FOREIGN PATENT DOCUMENTS

JP 2001-177302 6/2001
JP 2006-197479 7/2006
JP 5219750 6/2013

OTHER PUBLICATIONS

International Search Report dated Jan. 6, 2015, in corresponding PCT International Application.

* cited by examiner

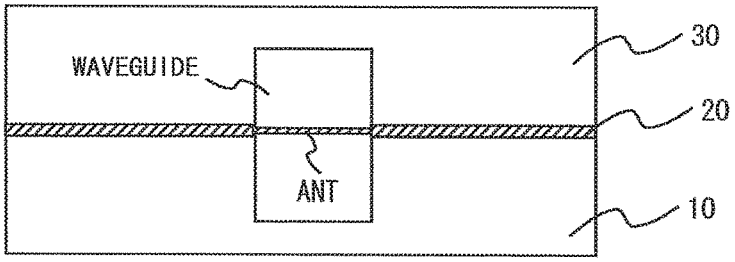
Fig. 2A SIDE VIEW OF WAVEGUIDE COAXIAL CONVERSION DEVICE AS VIEWED FROM WAVEGUIDE-TRANSMISSION-SYSTEM SIDE
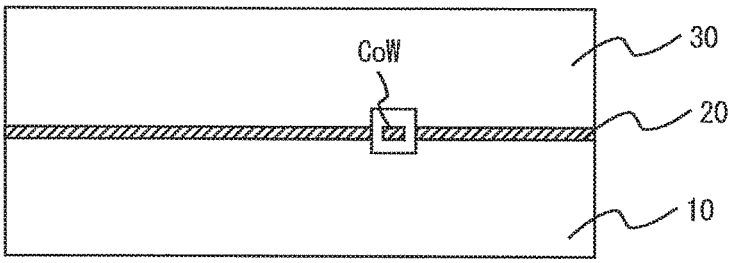
Fig. 2B SIDE VIEW OF WAVEGUIDE COAXIAL CONVERSION DEVICE AS VIEWED FROM COAXIAL-TRANSMISSION-SYSTEM SIDE
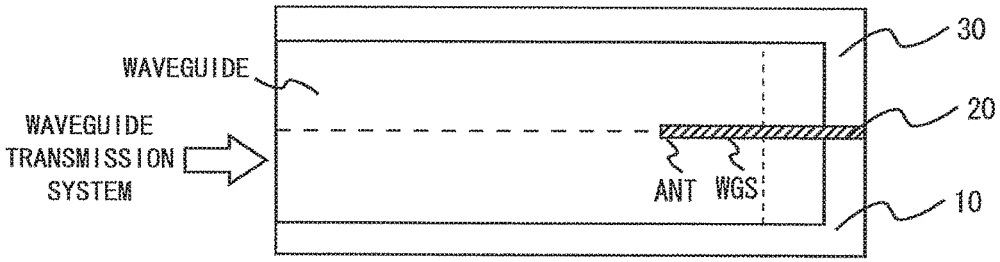
Fig. 2C SECTIONAL VIEW OF WAVEGUIDE COAXIAL CONVERSION DEVICE TAKEN ALONG LINE II-II

WAVEGUIDE COAXIAL CONVERSION DEVICE AND TRANSMISSION/RECEPTION INTEGRATED SPLITTER

CROSS-REFERENCE TO RELATED PATENT APPLICATIONS

This application is a National Stage Entry of International Application No. PCT/JP2014/005064, filed Oct. 3, 2014, which claims priority from Japanese Patent Application No. 2013-210072, filed Oct. 7, 2013. The entire contents of the above-referenced applications are expressly incorporated herein by reference.

TECHNICAL FIELD

The present invention relates to a waveguide coaxial conversion device and a transmission/reception integrated splitter. For example, the present invention relates to a waveguide coaxial conversion device and a transmission/reception integrated splitter which convert a signal of a waveguide transmission system to/from a signal of a coaxial transmission system.

BACKGROUND ART

A transmitter-receiver that handles high-frequency signals uses a waveguide to transmit the signals with high electrical power. However, the signals transmitted through the waveguide cannot be directly handled in an electronic circuit. For this reason, the high-frequency transmitter-receiver uses a waveguide coaxial conversion device that performs conversion of signals between a waveguide transmission system and a coaxial transmission system. Examples of such a waveguide coaxial conversion device are disclosed in Patent Literature 1 and 2.

Patent Literature 1 discloses a waveguide coaxial conversion device having a function of converting a coaxial transmission system to/from a waveguide transmission system, and a function of transmitting/receiving fundamental TE modes with opposite phases to/from a first fundamental TE mode transmission line and a second fundamental TE mode transmission line, respectively, which are partitioned by a metal plate.

Patent Literature 2 discloses a dielectric rod antenna including: a waveguide; a dielectric rod projecting from an opening at a distal end of the waveguide; and a feeding portion provided at a proximal end of the waveguide. In this dielectric rod antenna, a dielectric substrate constituting a fin line F with the width of the electrode thereof gradually decreasing toward the distal end opening is inserted into the waveguide. Accordingly, in Patent Literature 2, the operating frequency band in the fundamental mode is increased by decreasing the cut-off frequency in the fundamental mode, without changing the cut-off frequency of a higher-order mode.

CITATION LIST

Patent Literature

Patent Literature 1: Japanese Examined Patent Application Publication No. H05-075201

Patent Literature 2: Japanese Unexamined Patent Application Publication No. 2001-102856

SUMMARY OF INVENTION

Technical Problem

However, a signaling system used for radio communication or the like is required to have frequency characteristics for transmitting necessary high-frequency signals, as well as a filter function for attenuating signals in unwanted frequency bands. In the techniques disclosed in Patent Literature 1 and 2, it is necessary to separately provide a filter portion to achieve the filter function, which causes a problem that the size of the device increases.

Solution to Problem

A waveguide coaxial conversion device according to an exemplary aspect of the present invention includes: a first member; a second member provided so as to be opposed to the first member; and a conductor plate provided so as to be sandwiched between the first member and the second member. A waveguide is formed in the first member and the second member to a depth from a first surface of the first member to a surface that does not penetrate the second member, the first surface being connected with an external waveguide that is externally provided. The conductor plate includes: an opening having a shape corresponding to a shape of an aperture plane of the waveguide; a conductor surface portion provided around the opening; an antenna portion formed so as to cross the opening; a waveguide short-circuit portion that is perpendicular to the antenna portion and connects the antenna portion with the conductor surface portion; a coaxial wiring portion provided at one end of the antenna portion; and a coaxial line short-circuit portion configured to connect another end of the antenna portion of the conductor plate with the conductor surface portion.

A transmission/reception integrated splitter according to the present invention includes the above-described waveguide coaxial conversion device; and a coaxial circulator configured to transmit a signal received from a first path to a coaxial wiring portion of the waveguide coaxial conversion device, and outputs, to a second path, the signal transmitted from the coaxial wiring portion of the waveguide coaxial conversion device.

Advantageous Effects of Invention

According to a waveguide coaxial conversion device and a transmission/reception integrated splitter of the present invention, it is possible to reduce the volume of the waveguide coaxial conversion device having a filter function.

BRIEF DESCRIPTION OF DRAWINGS

FIG. 2 is a side view and a sectional view of the waveguide coaxial conversion device according to the first exemplary embodiment;

DESCRIPTION OF EMBODIMENTS

First Exemplary Embodiment

Figure 1:
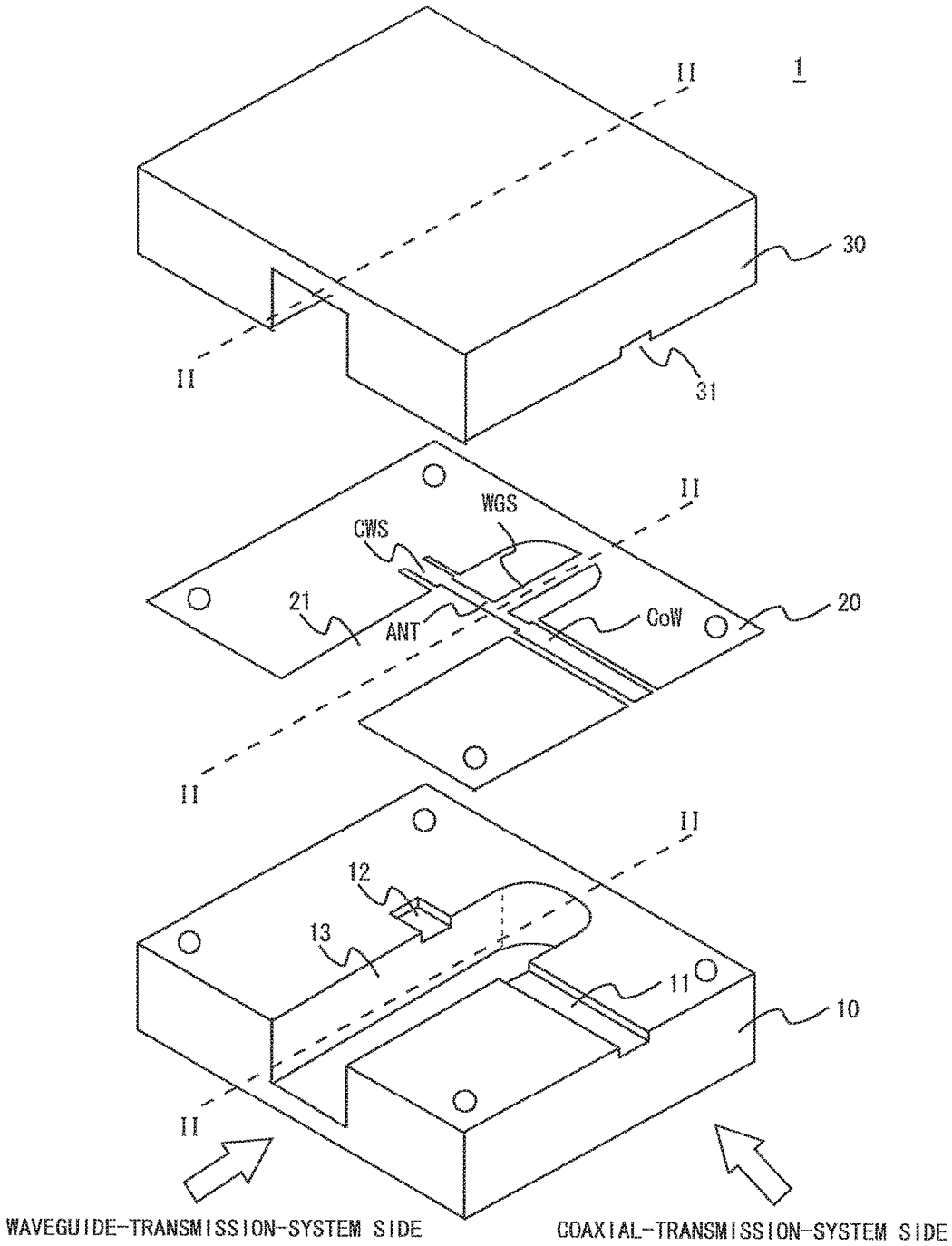
FIG. 1 is a schematic view showing a waveguide coaxial conversion device according to a first exemplary embodiment.

Exemplary embodiments of the present invention will be described below with reference to the drawings. Note that in the following description, the drawings are simplified as appropriate for simplification of the description. FIG. 1 shows a schematic view of a waveguide coaxial conversion device 1 according to a first exemplary embodiment.

As shown in FIG. 1, the waveguide coaxial conversion device 1 according to the first exemplary embodiment includes a first member 10, a conductor plate 20, and a second member 30. The first member 10, the second member 30, and the conductor plate 20 are made of metal such as stainless steel or copper. In the waveguide coaxial conversion device 1 according to the first exemplary embodiment, an antenna portion and a coaxial wiring portion are formed in the conductor plate 20. The waveguide coaxial conversion device 1 according to the first exemplary embodiment has a configuration in which the conductor plate 20 is sandwiched between the first member 10 and the second member 30.

The first member 10 has a waveguide 13 formed therein. The waveguide 13 is formed in such a manner that the waveguide has an annular shape in a state where the first member 10, the conductor plate 20, and the second member 30 are brought into close contact with each other, and the waveguide has an opening on a surface where the thickness of an antenna ANT can be confirmed. Specifically, the waveguide 13 is formed of a groove which is formed with an opening on one surface of the first member 10, and a groove which is formed with an opening on one surface of the second member. In other words, the waveguide 13 formed in the first member 10 is formed of grooves that do not penetrate the first member 10 and the second member 30.

The first member 10 has grooves 11 and 12 formed therein. The groove 11 is formed at a position corresponding to a coaxial wiring portion CoW which is formed in the conductor plate 20. The groove 11 is formed with a width (a length of a side in contact with the waveguide 13) which is greater than the width of the coaxial wiring portion CoW. The groove 12 is formed at a position corresponding to a coaxial short-circuit portion CWS which is formed in the conductor plate 20. The groove 12 is formed with a width (a length of a side in contact with the waveguide 13) which is greater than the width of the coaxial short-circuit portion CWS. The groove 12 is formed with a length (a length in a direction perpendicular to the side in contact with the waveguide 13) which is not greater than the length from the waveguide 13 to the first member 10.

In the second member 30, grooves identical to the grooves 11 and 12 are formed at positions respectively corresponding to the grooves 11 and 12 in the surface of the second member 30 that is opposed to the first member 10. In FIG. 1, the groove corresponding to the groove 11 in the second member 30 is denoted by reference numeral 31.

The conductor plate 20 has an opening 21 which is formed at a position corresponding to the waveguide 13. A portion of the conductor plate 20 that is located on the periphery of the opening 21 is hereinafter referred to as a conductor surface portion. The conductor plate 20 includes an antenna portion ANT, a waveguide short-circuit portion WGS, the coaxial wiring portion CoW, and the coaxial short-circuit portion CWS. The antenna portion ANT is formed so as to cross the opening 21 formed in the conductor plate 20. The waveguide short-circuit portion WGS is perpendicular to the antenna portion ANT, and is formed so as to connect the antenna portion ANT with the conductor surface portion. The coaxial wiring portion CoW is provided at one end of the antenna portion ANT, and is connected to a wire or a circuit in a subsequent stage (not shown). The coaxial short-circuit portion CWS connects the other end of the antenna portion ANT with the conductor surface portion.

The antenna portion ANT, the waveguide short-circuit portion WGS, the coaxial wiring portion CoW, and the coaxial short-circuit portion CWS are lines formed of the same material as that of the conductor surface portion. In the example shown in FIG. 1, one end of the waveguide short-circuit portion WGS and one end of the coaxial short-circuit portion CWS are continuous with the conductor surface portion. The antenna portion ANT is continuous with the other end of the waveguide short-circuit portion WGS and the other end of the coaxial short-circuit portion CWS. The coaxial wiring portion CoW is continuous with one end of the antenna portion ANT. Note that the coaxial wiring portion CoW may be continuous with the conductor surface portion in a region (not shown).

A surface of the first member 10 where the surface to be connected to the external waveguide can be seen is hereinafter referred to as a waveguide transmission system surface. A surface of the first member 10 where the cross-section of the coaxial wiring portion CoW can be seen is hereinafter referred to as a coaxial transmission system surface.

Next, FIG. 2 shows a side view and a sectional view of the waveguide coaxial conversion device 1 according to the first exemplary embodiment. The waveguide coaxial conversion device 1 will be described in more detail below with reference to FIG. 2.

The upper part in FIG. 2 is a side view of the waveguide coaxial conversion device 1 when the waveguide coaxial conversion device 1 is viewed from the waveguide transmission system surface. As shown in the upper figure of FIG. 2, in the waveguide coaxial conversion device 1, the waveguide 13 is formed of a pipe that is composed of the first member 10 and the second member 30. Accordingly, when viewed from the waveguide transmission system surface, the thickness of the antenna portion ANT which is formed so as to cross the waveguide 13 can be confirmed. Further, since the waveguide short-circuit portion WGS extends from the antenna portion ANT to the back side of the waveguide 13, the waveguide short-circuit portion WGS cannot be confirmed in the upper figure of FIG. 2.

The middle figure in FIG. 2 is a side view of the waveguide coaxial conversion device 1 as viewed from the coaxial transmission system surface of the waveguide coaxial conversion device 1. FIG. 1 shows the components separately for ease of explanation of each component. However, as shown in the middle figure of FIG. 2, the waveguide coaxial conversion device 1 has a shape in which the first member 10 and the second member 30 sandwich the conductor plate 20 and these components are brought into close contact with each other as viewed from the coaxial transmission system surface. The first member 10, the conductor plate 20, and the second member 30 are brought into close contact with each other by a bolt or a conductive adhesive (for example, solder). Further, as shown in the middle figure of FIG. 2, in the waveguide coaxial conversion device 1, the cross-section of the coaxial wiring portion CoW can be seen when it is viewed from the coaxial transmission system surface. The coaxial wiring portion CoW is flush with the conductor plate 20. However, when viewed from the coaxial transmission system surface, the conductor plate 20 and the coaxial wiring portion CoW are formed so as to be apart from each other.

The lower figure in FIG. 2 is a sectional view of the waveguide coaxial conversion device 1. This sectional view is taken along a line II-II of FIG. 1. As shown in the lower figure of FIG. 2, the waveguide 13 of the waveguide coaxial conversion device 1 is formed as a pipe which extends from a first surface of the waveguide coaxial conversion device 1 to a second surface opposed to the first surface, and which does not penetrate the second surface. As shown in the sectional view of FIG. 2, in the waveguide coaxial conversion device 1, the antenna portion ANT and the waveguide short-circuit portion WGS are formed within the waveguide 13.

In the waveguide coaxial conversion device 1 according to the first exemplary embodiment, the above-described conductor plate 20 is sandwiched between the first member 10 and the second member 30, thereby converting a signal to be transmitted through the waveguide to/from a signal to be transmitted through a coaxial line. The waveguide coaxial conversion device 1 constitutes a band-pass filter, which allows a desired signal in the signals to be converted to pass without attenuation, and a band rejection filter which attenuates unwanted frequency components. In this regard, FIG. 3 is a graph showing frequency characteristics of the waveguide coaxial conversion device 1 according to the first exemplary embodiment.

Figure 3:
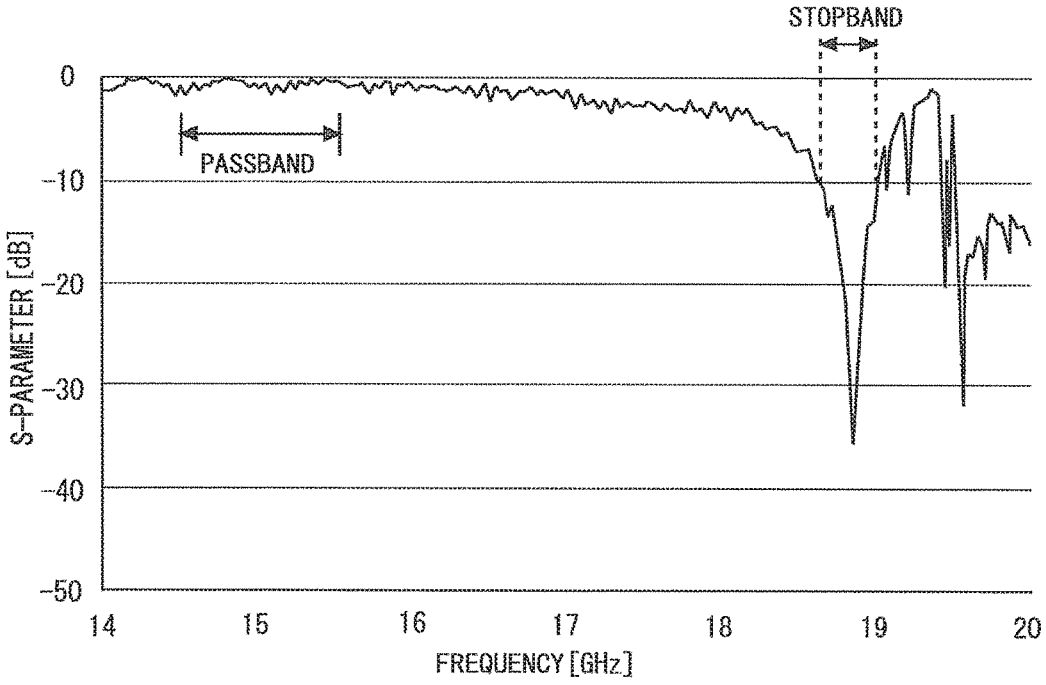
FIG. 3 is a graph showing frequency characteristics of the waveguide coaxial conversion device according to the first exemplary embodiment.

In the example shown in FIG. 3, the waveguide coaxial conversion device 1 according to the first exemplary embodiment is characterized by allowing signals in a frequency band from 14.5 GHz to 15.5 GHz to pass with almost no attenuation in the amplitude level of the signals, and by attenuating the level of signals in a frequency band from 18.5 GHz to 19 GHz.

In the waveguide coaxial conversion device 1 according to the first exemplary embodiment, the frequency band for the band-pass filter and the frequency band for the band rejection filter are set by changing the dimensions and shapes of the antenna portion ANT, the coaxial short-circuit portion CWS, and the waveguide short-circuit portion WGS. In this regard, FIG. 4 shows a diagram for explaining frequency setting parameters of the waveguide coaxial conversion device 1.

Figure 4:
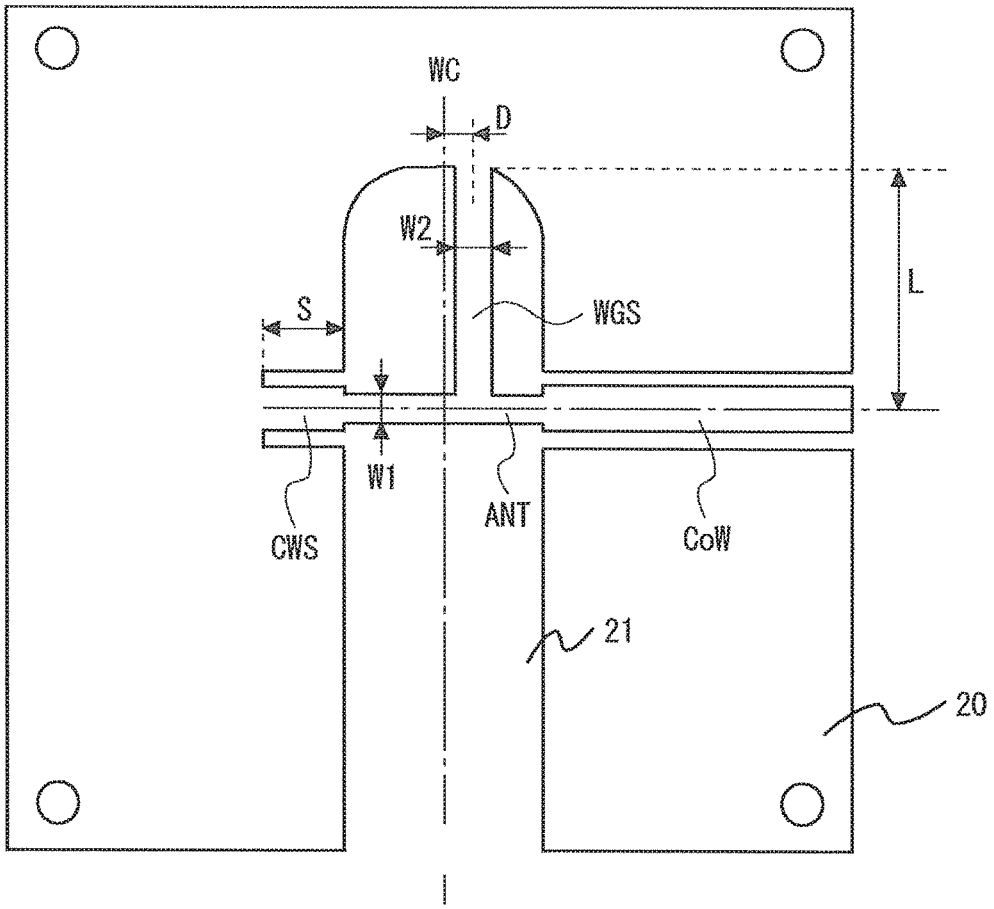
FIG. 4 is a diagram for explaining frequency setting parameters of the waveguide coaxial conversion device according to the first exemplary embodiment.

The dimensions and shape of the waveguide coaxial conversion device are represented by values as shown in FIG. 4. Specifically, the distance between a central line in the width direction of the antenna portion ANT (for example, in the direction perpendicular to the direction in which the antenna portion ANT crosses the opening 21 (or the waveguide 13)) and a portion where the waveguide short-circuit portion WGS is connected to the conductor surface is represented by L. The distance between a central line in the length of the antenna portion ANT (for example, in the longitudinal direction of the antenna portion ANT), and a central line in the width direction of the waveguide short-circuit portion WGS (for example, in the lateral direction of the waveguide short-circuit portion WGS) is represented by D. The length of the coaxial short-circuit portion CWS (the distance from the opening 21 to the conductor surface) is represented by S. The width of the antenna portion ANT is represented by W1. The width of the waveguide short-circuit portion WGS is represented by W2.

In the waveguide coaxial conversion device 1 according to the first exemplary embodiment, the frequency band of signals that are allowed to pass by the band-pass filter is determined by adjusting the parameter L among the above-mentioned parameters. If a larger value is set for the parameter L, the frequency of the passband decreases. If a smaller value is set for the parameter L, the frequency of the passband increases. The waveguide coaxial conversion device 1 determines the frequency of the stopband by adjusting the parameter S. If a larger value is set for the parameter S, the frequency of the stopband decreases. If a smaller value is set for the parameter S, the frequency of the stopband increases. Further, the waveguide coaxial conversion device 1 performs impedance matching of passbands by adjusting the parameters D, W1, and W2.

As described above, the waveguide coaxial conversion device 1 according to the first exemplary embodiment has a configuration in which the antenna portion ANT which is formed in the waveguide 13 is provided with the waveguide short-circuit portion WGS and the coaxial short-circuit portion CWS. This configuration allows the band rejection filter that attenuates signals in unwanted frequency bands while allowing signals in necessary frequency bands to pass, to be mounted on the waveguide coaxial conversion device 1 according to the first exemplary embodiment without increasing the area or volume of the device. That is, according to the waveguide coaxial conversion device 1 of the first exemplary embodiment, the waveguide coaxial conversion device including the band rejection filter can be downsized.

Second Exemplary Embodiment

Figure 5:
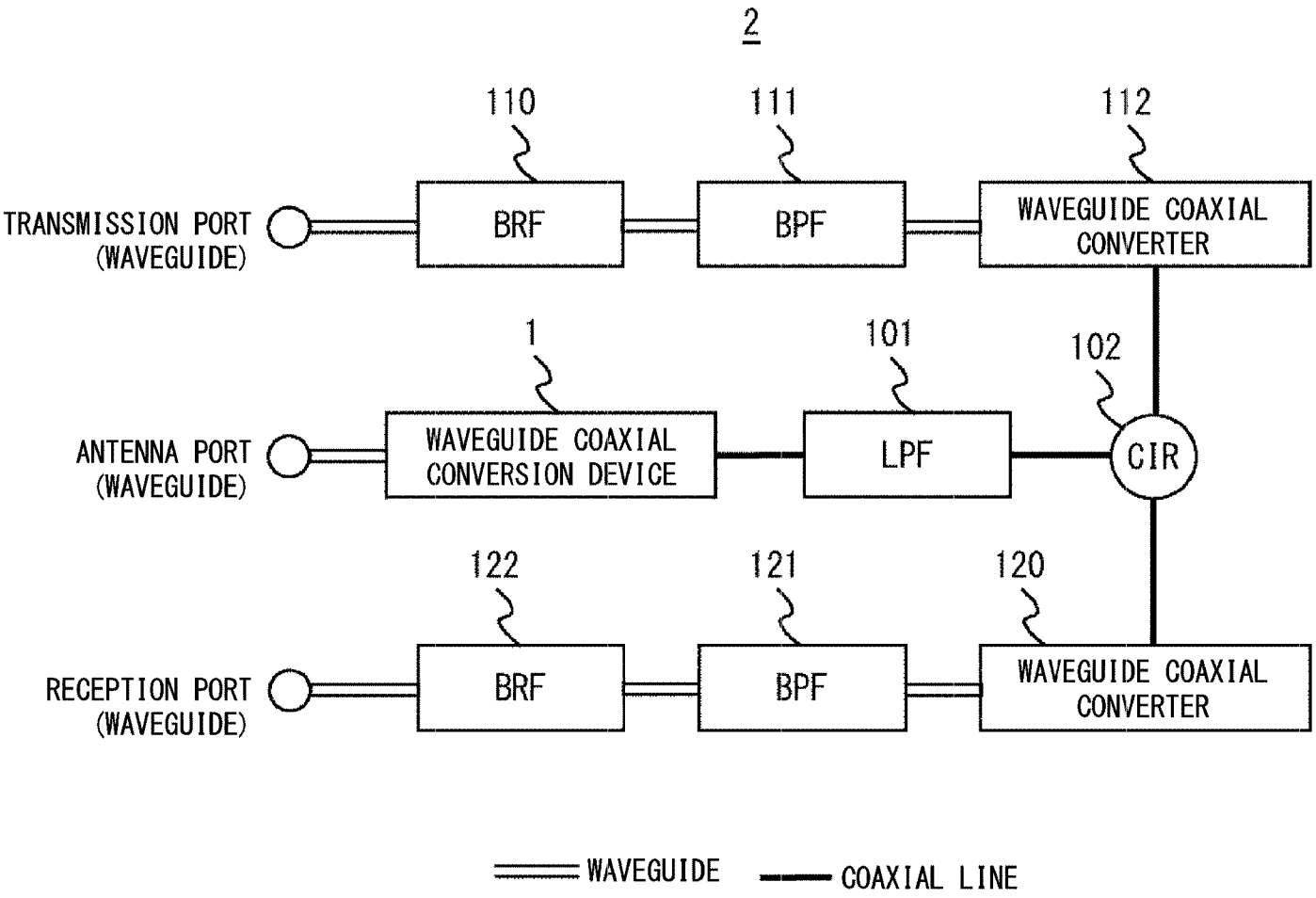
FIG. 5 is a block diagram showing a transmission/reception integrated splitter according to a second exemplary embodiment.

A second exemplary embodiment illustrates an example in which the waveguide coaxial conversion device 1 according to the first exemplary embodiment is applied to a transmission/reception integrated splitter. FIG. 5 shows a block diagram of a transmission/reception integrated splitter 2 according to the second exemplary embodiment.

The transmission/reception integrated splitter 2 shown in FIG. 5 includes the waveguide coaxial conversion device 1, a low-pass filter 101, a circulator 102, a band rejection filter 110, a band-pass filter 111, a waveguide coaxial converter 112, a waveguide coaxial converter 120, a band-pass filter 121, and a band rejection filter 122.

In the transmission/reception integrated splitter 2 according to the second exemplary embodiment, the waveguide coaxial conversion device 1 according to the first exemplary embodiment is used for an antenna port, thereby using a coaxial circulator (hereinafter referred to as the coaxial circulator 102) as the circulator 102. The coaxial circulator 102 transmits a signal received from a first path (for example, a path to be connected to a transmission port) to the coaxial wiring portion CoW of the waveguide coaxial conversion device 1. Further, the coaxial circulator 102 outputs a signal to be transmitted from the coaxial wiring portion CoW of the waveguide coaxial conversion device 1 to a second path (for example, a path to be connected to a reception port).

The transmission/reception integrated splitter 2 according to the second exemplary embodiment includes a third filter portion (for example, the low-pass filter 101) which is provided between the waveguide coaxial conversion device 1 and the coaxial circulator 102. The low-pass filter 101 is a low-pass filter formed on the coaxial line.

In the transmission/reception integrated splitter 2 according to the second exemplary embodiment, a first waveguide coaxial converter (for example, the waveguide coaxial converter 112) is connected to the first-path-side port of the coaxial circulator 102, and a second waveguide coaxial converter (for example, the waveguide coaxial converter 120) is connected to the second-path-side port of the coaxial circulator 102. The waveguide coaxial converter 112 and the waveguide coaxial converter 120 convert signals between the waveguide transmission system and the coaxial transmission system by the antenna provided in the waveguide.

Further, in the transmission/reception integrated splitter 2, a first filter portion (for example, the band rejection filter 110 and the band-pass filter 111) which is connected between the waveguide coaxial converter 112 and an input port (for example, the transmission port) is provided. The path from the band rejection filter 110 to the waveguide coaxial converter 112 is a path for the waveguide transmission system. In other words, the band rejection filter 110 and the band-pass filter 111 constitute a filter in the shape of the waveguide.

Further, in the transmission/reception integrated splitter 2, a second filter portion (for example, the band-pass filter 121 and the band rejection filter 122) which is connected between the waveguide coaxial converter 120 and an output port (for example, the reception port) is provided. The path from the waveguide coaxial converter 120 to the band rejection filter 122 is a path for the waveguide transmission system. In other words, the band-pass filter 121 and the band rejection filter 122 constitute a filter in the shape of the waveguide.

The circulator can be formed of a waveguide type circulator. However, if the circulator is formed of a coaxial type circulator, the circulator can be downsized. Similarly, if the low-pass filter is formed of a coaxial type filter rather than a waveguide type filter, the low-pass filter can be downsized.

As described above, in the second exemplary embodiment, the use of the waveguide coaxial conversion device 1 makes it possible to configure the transmission/reception integrated splitter using a filter and a circulator which contributes to downsizing of the device. Accordingly, the entire transmission/reception integrated splitter 2 can be configured using a small circulator. Further, according to the transmission/reception integrated splitter 2 of the second exemplary embodiment, the transmission/reception integrated splitter 2 incorporating the band rejection filter can be realized by using the waveguide coaxial conversion device 1 according to the first exemplary embodiment, without increasing the size of the device.

Figure 6:
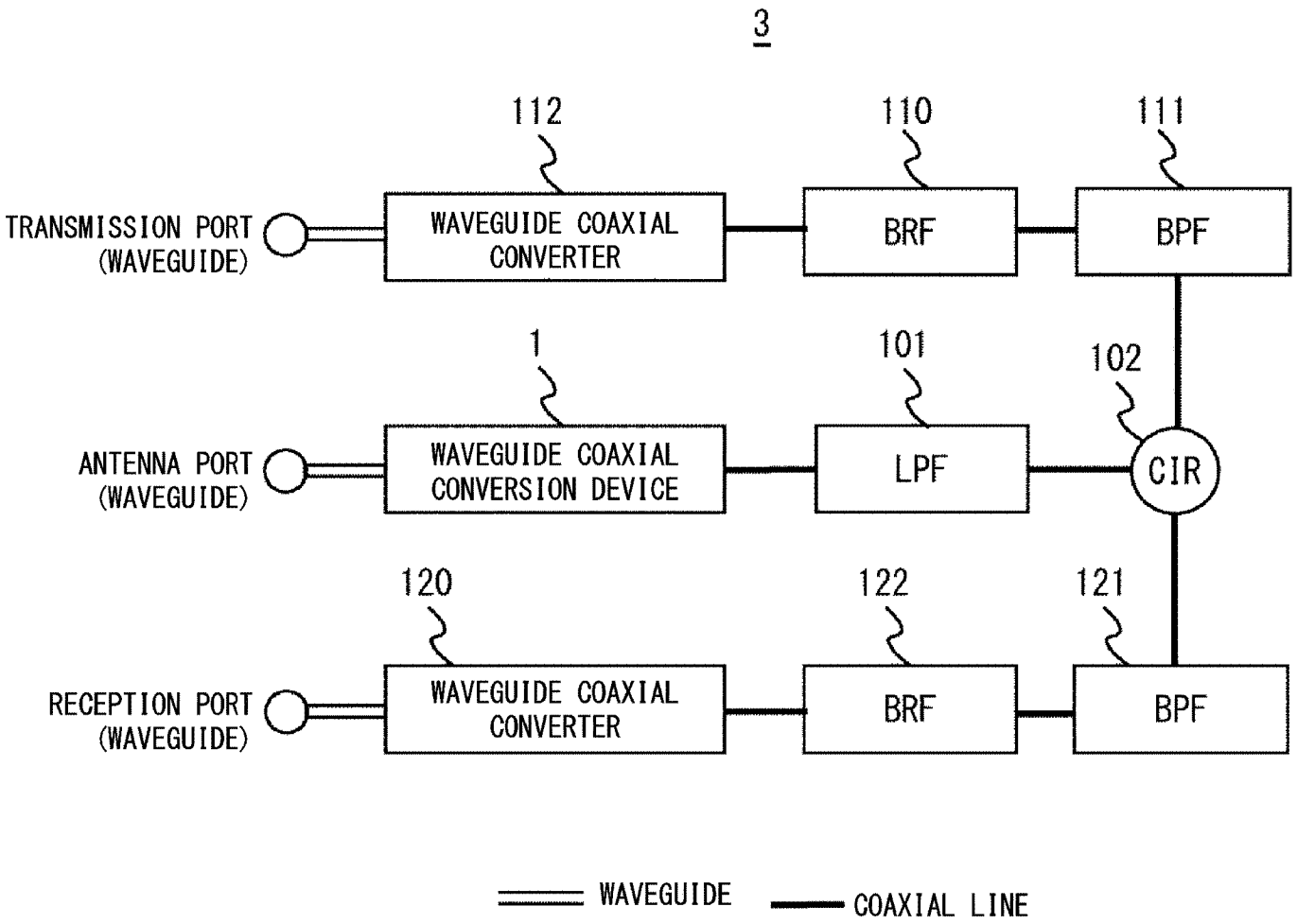
FIG. 6 is a block diagram showing a modified example of the transmission/reception integrated splitter according to the second exemplary embodiment.

A configuration shown in FIG. 6 can be employed as another form of the transmission/reception integrated splitter 2 shown in FIG. 5. FIG. 6 shows a transmission/reception integrated splitter 3 which is another form of the transmission/reception integrated splitter 2. In the transmission/reception integrated splitter 3, the waveguide coaxial converter 112 is connected to the transmission port, and the band rejection filter 110 and the band-pass filter 111, which are formed on the coaxial line, are provided between the waveguide coaxial converter 112 and the coaxial circulator 102. Further, in the transmission/reception integrated splitter 3, the band-pass filter 121 and the band rejection filter 122, which are formed on the coaxial line, are provided in the subsequent stage of the coaxial circulator 102. The waveguide coaxial converter 120 is provided between the band rejection filter 122 and the reception port. In this manner, the band rejection filter 110, the band-pass filter 111, the band-pass filter 121, and the band rejection filter 122 can be formed on the coaxial line, or can be formed on the waveguide. It can be appropriately determined whether these filters are formed on the coaxial line or on the waveguide depending on the use of the transmission/reception integrated splitter.

Note that the present invention is not limited to the above exemplary embodiments and can be modified as appropriate without departing from the scope of the invention.

This application is based upon and claims the benefit of priority from Japanese patent application No. 2013-210072, filed on Oct. 7, 2013, the disclosure of which is incorporated herein in its entirety by reference.

REFERENCE SIGNS LIST

1 WAVEGUIDE COAXIAL CONVERSION DEVICE
2, 3 TRANSMISSION/RECEPTION INTEGRATED SPLITTER
10 FIRST MEMBER
11, 12, 13, 31 GROOVE
13 WAVEGUIDE
20 CONDUCTOR PLATE
21 OPENING
30 SECOND MEMBER
101 LOW-PASS FILTER
102 COAXIAL CIRCULATOR
110 BAND REJECTION FILTER
111 BAND-PASS FILTER
112 WAVEGUIDE COAXIAL CONVERTER
120 WAVEGUIDE COAXIAL CONVERTER
121 BAND-PASS FILTER
122 BAND REJECTION FILTER
ANT ANTENNA PORTION
CoW COAXIAL WIRING PORTION
CWS COAXIAL SHORT-CIRCUIT PORTION
WGS WAVEGUIDE SHORT-CIRCUIT PORTION
WC ANTENNA CENTER LINE

The invention claimed is:

1. A waveguide coaxial conversion device comprising:
a first member;
a second member provided so as to be opposed to the first member; and
a conductor plate provided so as to be sandwiched between the first member and the second member, wherein
the conductor plate includes:
an opening having a shape corresponding to a shape of a groove of a waveguide on a surface of the first member that is opposed to the conductor plate;
a conductor surface portion provided around the opening;
an antenna portion formed so as to cross the opening;
a waveguide short-circuit portion that is perpendicular to the antenna portion and connects the antenna portion with the conductor surface portion;
a coaxial wiring portion provided at one end of the antenna portion; and
a coaxial line short-circuit portion configured to connect another end of the antenna portion of the conductor plate with the conductor surface portion, and
the first member and the second member each include a groove in which the waveguide is formed, and grooves formed at positions respectively corresponding to the coaxial wiring portion and the coaxial line short-circuit portion.

2. The waveguide coaxial conversion device according to claim 1, wherein
a length of the waveguide short-circuit portion is determined by a passband of a signal to be transmitted, and
a length of the coaxial line short-circuit portion is determined by a stopband of a signal to be transmitted.

3. The waveguide coaxial conversion device according to claim 1, wherein passband matching of signals to be transmitted is adjusted according to a distance between a center position of the antenna portion and a center position of the waveguide short-circuit portion, a width of the antenna portion, and a width of the waveguide short-circuit portion.

4. A transmission/reception integrated splitter, comprising:

the waveguide coaxial conversion device according to claim 1; and a coaxial circulator configured to transmit a signal received from a first path to a coaxial wiring portion of the waveguide coaxial conversion device, and outputs, to a second path, the signal transmitted from the coaxial wiring portion of the waveguide coaxial conversion device.

5. The transmission/reception integrated splitter according to claim 4, further comprising:

a first waveguide coaxial converter connected to a first-path-side port of the coaxial circulator;

a first filter portion connected between the first waveguide coaxial converter and an input port;

a second waveguide coaxial converter connected to a second-path-side port of the coaxial circulator; and a second filter portion connected between the second waveguide coaxial converter and an output port.

6. The transmission/reception integrated splitter according to claim 4, further comprising a third filter portion provided between the waveguide coaxial conversion device and the coaxial circulator.

7. A waveguide coaxial conversion device comprising:

a first member connected with an external waveguide;

a second member provided so as to be opposed to the first member; and a conductor plate provided so as to be sandwiched between the first member and the second member, wherein the conductor plate includes:

an opening having a shape corresponding to an aperture plane of the waveguide;

an antenna portion formed so as to cross the opening;

a coaxial short-circuit portion configured to connect one end of the antenna portion to a conductor portion of the conductor plate;

a coaxial wiring portion provided at another end of the antenna portion; and a waveguide short-circuit portion configured to connect a node between one end and another end of the antenna portion to the conductor portion of the conductor plate.

* * * * *